US005265696A

United States Patent [19]

Casebolt

[11] Patent Number: 5,265,696

[45] Date of Patent: Nov. 30, 1993

[54] LADDER CLIMBING SAFETY CLAMP

[75] Inventor: Scott C. Casebolt, North St. Paul, Minn.

[73] Assignee: D B Industries, Inc., Redwing, Minn.

[21] Appl. No.: 829,733

[22] Filed: Jan. 31, 1992

[51] Int. Cl.[5] ..... E06C 5/36

[52] U.S. Cl. ..... 182/8; 182/92; 188/65.2

[58] Field of Search ..... 182/8, 5, 191–193; 188/65.2; 24/134 R

[56] References Cited

U.S. PATENT DOCUMENTS

| | | | |
|---|---|---|---|
| Re. 30,072 | 8/1979 | Kleine et al. | 182/8 |
| 2,080,700 | 5/1937 | Dale | 24/134 R |
| 3,177,543 | 4/1965 | Fountain | 24/126 |
| 3,674,116 | 7/1972 | Vogeli | 182/192 X |
| 3,876,036 | 4/1975 | Sweet | 182/18 |
| 3,908,791 | 9/1975 | Kleine et al. | 182/8 |
| 3,979,797 | 9/1976 | Stember | 24/134 R |
| 4,034,828 | 7/1977 | Rose et al. | 182/5 |
| 4,058,818 | 4/1978 | Swager | 182/47 |
| 4,071,926 | 2/1978 | Sweet et al. | 182/8 X |
| 4,077,094 | 3/1978 | Swager | 24/134 R |
| 4,193,475 | 3/1980 | Sweet et al. | 182/8 |
| 4,521,000 | 6/1985 | Dodge, Jr. | 254/391 |
| 5,056,619 | 10/1991 | Darnell et al. | 182/5 |

FOREIGN PATENT DOCUMENTS

| | | | |
|---|---|---|---|
| 774295 | 12/1967 | Canada | 24/134 R |
| 2812073 | 9/1979 | Fed. Rep. of Germany | 182/5 |
| 2405073 | 6/1979 | France | 182/5 |

*Primary Examiner*—Alvin C. Shin-Shue
*Attorney, Agent, or Firm*—Moore & Hansen

[57] ABSTRACT

A ladder climbing safety clamp is claimed that may be easily operated by a worker with one hand while overcoming many potential safety hazards of prior devices. The safety clamp includes a body with a U-shaped cable sleeve. A channel is included on one side of the body to permit the introduction of the safety line in the cable sleeve. However, if the cable is too large to operate properly with the safety clamp, it will not fit through the channel, thereby helping to prevent inadvertent usage of the safety clamp with a cable of a diameter for which it is not intended. A gravity stop is also provided to prevent the safety clamp from being inadvertently installed in an upside-down position, since the safety clamp would not operate correctly in that position.

16 Claims, 4 Drawing Sheets

LADDER CLIMBING SAFETY CLAMP

BACKGROUND OF THE INVENTION

1. Technical Field

The present invention relates generally to safety clamps attached to a user that come into gripping engagement with a safety line if the user falls. More particularly, the safety clamp attaches to a belt worn by the user, and incorporates a friction plate or shoe that is moved into gripping engagement with safety line adjacent the user's location, as for example on a ladder.

2. Background Information

Safety clamps of the type herein described have been known and used for many years. Similar devices are disclosed in U.S. Pat. No. 4,071,926, issued to Sweet et al. on Feb. 7, 1978, and U.S. Pat. No. Re. 30,072, originally issued to Kleine et al. as U.S. Pat. No. 3,908,791 on Sept. 30, 1975. A primary problem of prior safety clamps has been the need to use two hands to attach and remove the safety clamp to and from the safety line. Depending on the position of the worker at the time, this operation can be difficult at best, if not quite dangerous. Further, these devices are intended to permit easy ascent of the worker along a ladder or similar climbing device, while quickly engaging the safety line if the user suddenly falls. However, if the device is inadvertently installed in an upside down configuration, the user will have a difficult time climbing, and will receive no protection in the event of a fall.

Additionally, prior safety clamps frequently relied on the contact between the end of a cam arm and the safety line to provide the grasping action that stopped the fall of the worker. This was often the case even though a more secure grasping action is known to be had by using a larger surface are for contacting the safety line, such as may be obtained from a brake shoe, for example. Other devices have been developed that utilize a larger plate or shoe, but these have the accompanying problem of keeping the shoe properly aligned with the safety cable to maximize the surface area of the shoe in contact with the safety cable.

Another problem that can occur when using prior safety clamps is that they are frequently built to be used with cable of a specific diameter or close range of diameters However, there is not always a way of keeping the device from being used with a cable of a different size. In the event that this should occur, the performance of the safety clamp may be detrimentally affected, increasing the risk of failure of the safety clamp in the event the worker should fall.

The ladder climbing safety clamp of the present invention overcomes the difficulties described above and affords other features and advantages heretofore not available.

SUMMARY OF THE INVENTION

The ladder climbing safety clamp disclosed herein is an effective device that may be easily operated by a worker with one hand while overcoming many potential safety hazards of prior devices. The safety clamp includes a body with a U-shaped cable sleeve. A channel is included on one side of the body to permit the introduction of the safety line in the cable sleeve. However, if the cable is too large to operate properly with the safety clamp, it will not fit through the channel, thereby helping to prevent inadvertent usage of the safety clamp with a cable of a diameter for which it is not intended.

The main object of this invention is to provide a direct linkage safety clamp that permits one hand operation with improved safety and security. The safety clamp includes a palm lock that must be engaged before the lever arm, which may be attached to the worker's belt or harness, may be activated to fully disengage the brake shoe. Only after fully disengaging the brake shoe from the cable may the safety clamp be attached to or removed from the safety line.

Another object of this invention is to provide a ladder climbing safety clamp that may not be inadvertently installed in an upside down configuration. This is an important feature because if the safety clamp is installed upside down, it will not provide the clamping action that is necessary to stop the fall of a worker attached to the safety clamp.

Other objects and advantages of the invention will become apparent from the following detailed description and from the appended drawings in which like numbers have been used to describe like parts throughout the several views

DESCRIPTION OF THE PREFERRED EMBODIMENT

Figure 2:
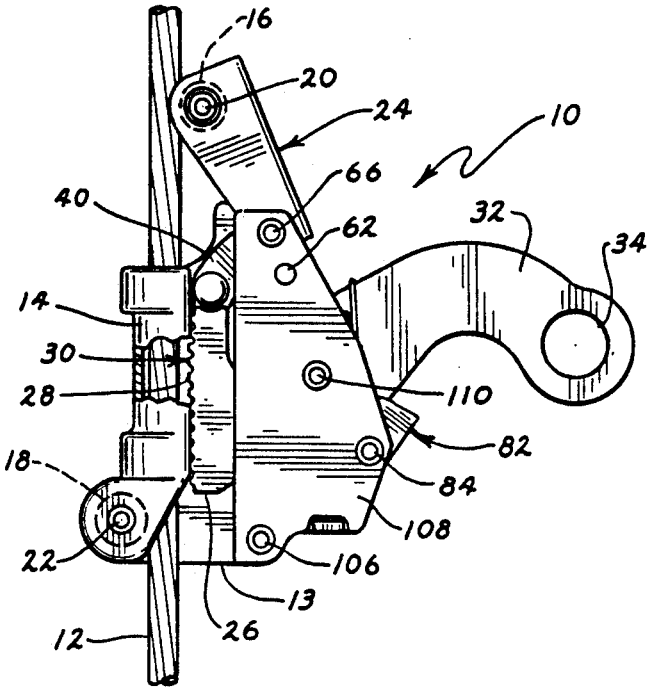
FIG. 2 is a side elevation of the safety clamp, with a portion cut away to show the location of the cable with respect to the shoe during normal use.

With reference to the drawings, and in particular to FIG. 2, the ladder climbing safety clamp is generally indicated by reference numeral 10. Safety clamp 10 cooperates with an elongated safety carrier such as cable 12, although it also may be used with a rod or other suitable structure.

Figure 1:
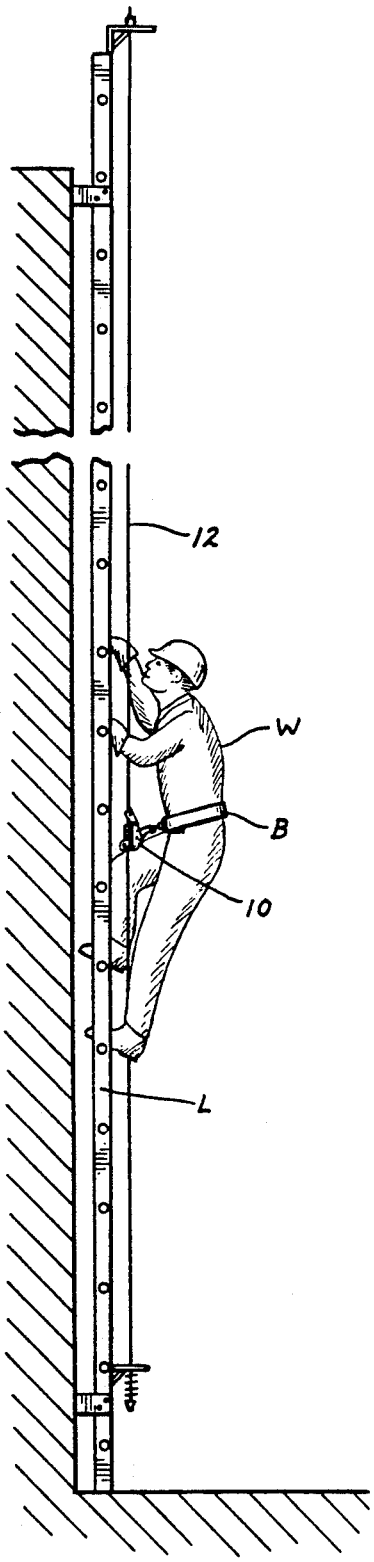
FIG. 1 is a side elevation of a worker using the safety clamp in a manner for which it is intended.

As illustrated in FIG. 1, safety clamp 10 is attached to a harness or belt B worn by a worker W. With worker W climbing or performing tasks from a ladder L, safety clamp 10 will quickly and securely engage cable 12, fixedly mounted adjacent to ladder L, in the event worker W falls from ladder L. Ladder L may be affixed to a tall structure such as a building or it ma be accessed through a utility access hole leading to a tunnel or other subterranean structure.

Figure 3:
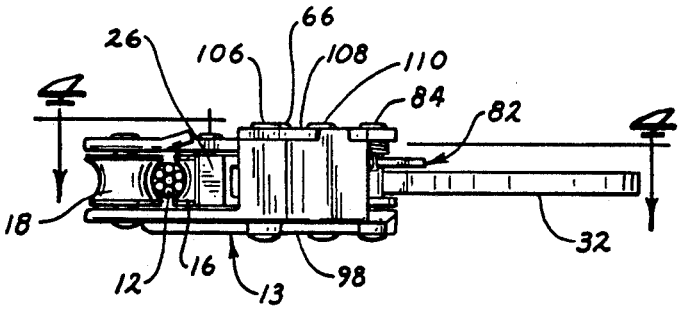
FIG. 3 is a bottom elevation of the safety clamp.
Figure 7:
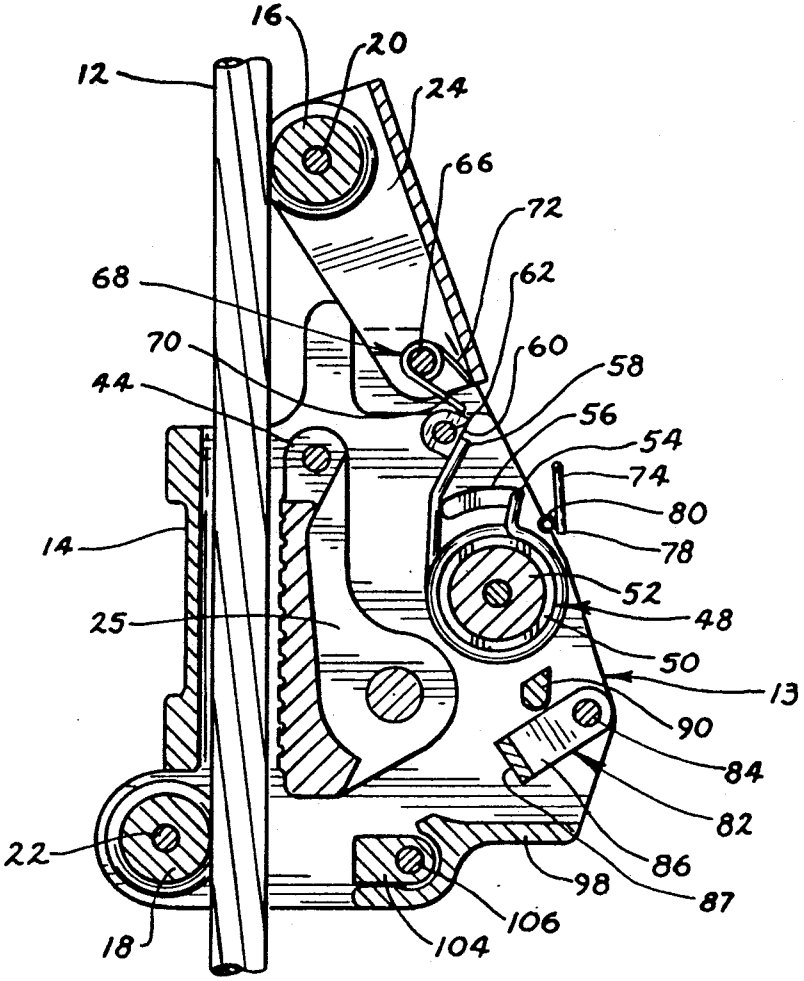
FIG. 7 is section view taken along line 7—7 of FIG. 6.

With reference to FIGS. 2, 3 and 7, the preferred embodiment of safety clamp 10 includes a sleeve housing 13 containing cable sleeve 14, through which passes cable 12. In the preferred embodiment, sleeve housing 13 is cast from high strength stainless steel. In normal use, as the worker ascends and descends ladder L, cable 12 easily passes through sleeve 14 of safety clamp 10, rolling along first or upper roller 16 and second or lower roller 18. First roller 16 is mounted on a rivet 20, and second roller 18 is mounted on a rivet 22. First roller 16 is mounted within hinged roller extension 24, while second roller 18 is mounted within the lower portion of cable sleeve 14. Hinged roller extension 24 is preferably made of stainless steel.

Brake shoe 26 includes several teeth 28 projecting from the brake shoe face 30. In the standard operating position illustrated in FIG. 2, brake shoe 26 is in a retracted position, and brake shoe face 30 is spaced from the cable 12.

Figure 4:
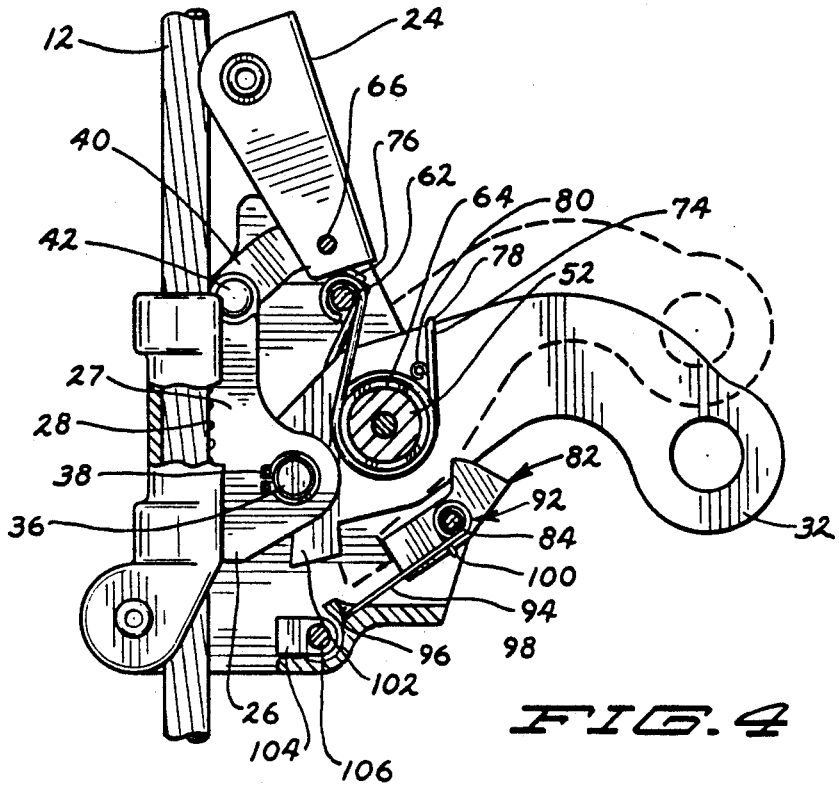
FIG. 4 is a section view taken along line 4—4 of FIG. 3.
Figure 5:
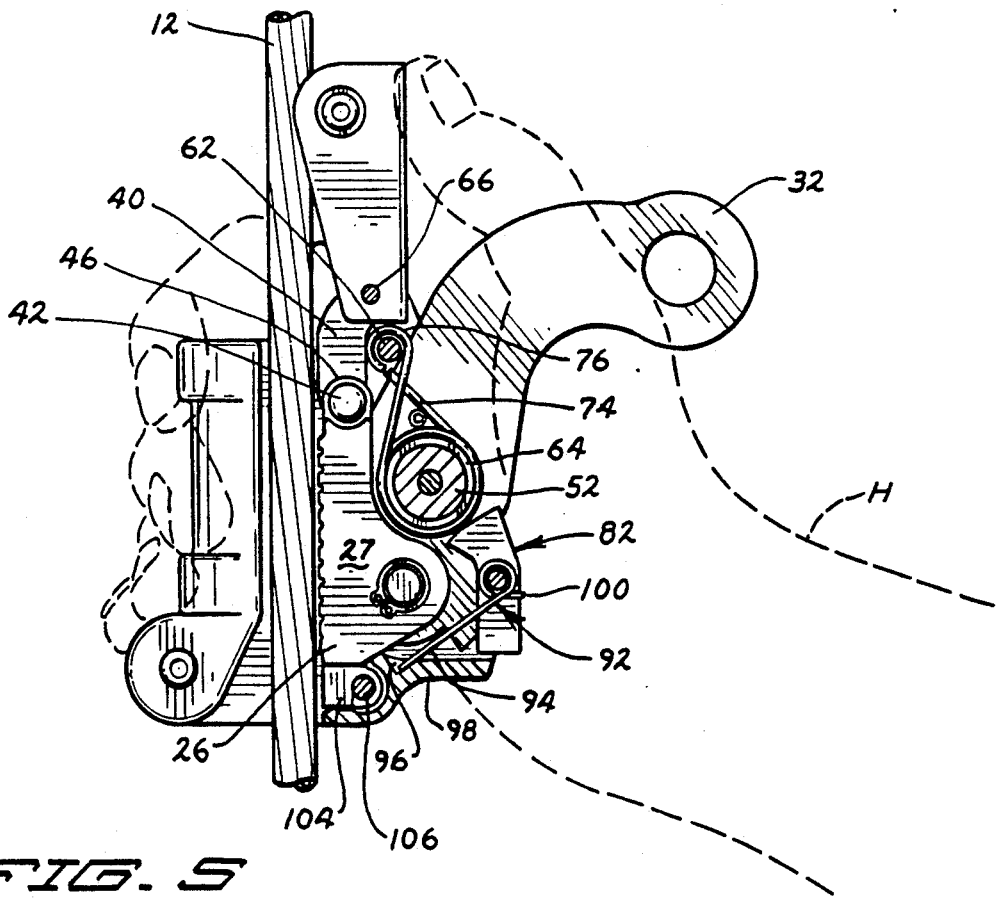
FIG. 5 is a view similar to that of FIG. 4 showing the safety clamp being activated in the user's hand for installation to or removal from a safety cable.

As is most clearly illustrated in FIG. 4, brake shoe 26 is hingedly linked to actuating arm 32. The far end of actuating arm 32 includes a large opening 34 to which may be attached a carabiner, snap hook or other fastener for attaching safety clamp 10 to belt B worn by worker W. Brake shoe 26 is linked to actuating arm 32 along pivot shaft 36. Brake shoe 26 is U-shaped in cross section, and the end of actuating arm 32 to which it is linked is positioned between the two projecting side portions of the shoe. Thus, brake shoe 26 is attached to actuating arm 32 by sliding pivot shaft 36 through an opening in the first side 25 of brake shoe 26, then through an opening in actuating arm 32, and finally through an opening in the second side 27 of brake shoe 26. Pivot shaft 36 preferably includes a groove (not shown) in which may be positioned retaining ring 38 for holding pivot shaft 36 in position relative to brake shoe 26 and actuating arm 32. The internal mechanism, as best shown in FIGS. 4 and 5, is completed when lever arm 40 is pivotally attached to brake shoe 26 by rivet 42. Lever arm 40 is attached to brake shoe 26 by sliding rivet 42 through an opening in first pivot portion 44, then through an opening in lever arm 40, and finally through an opening in second pivot portion 46.

Figure 8:
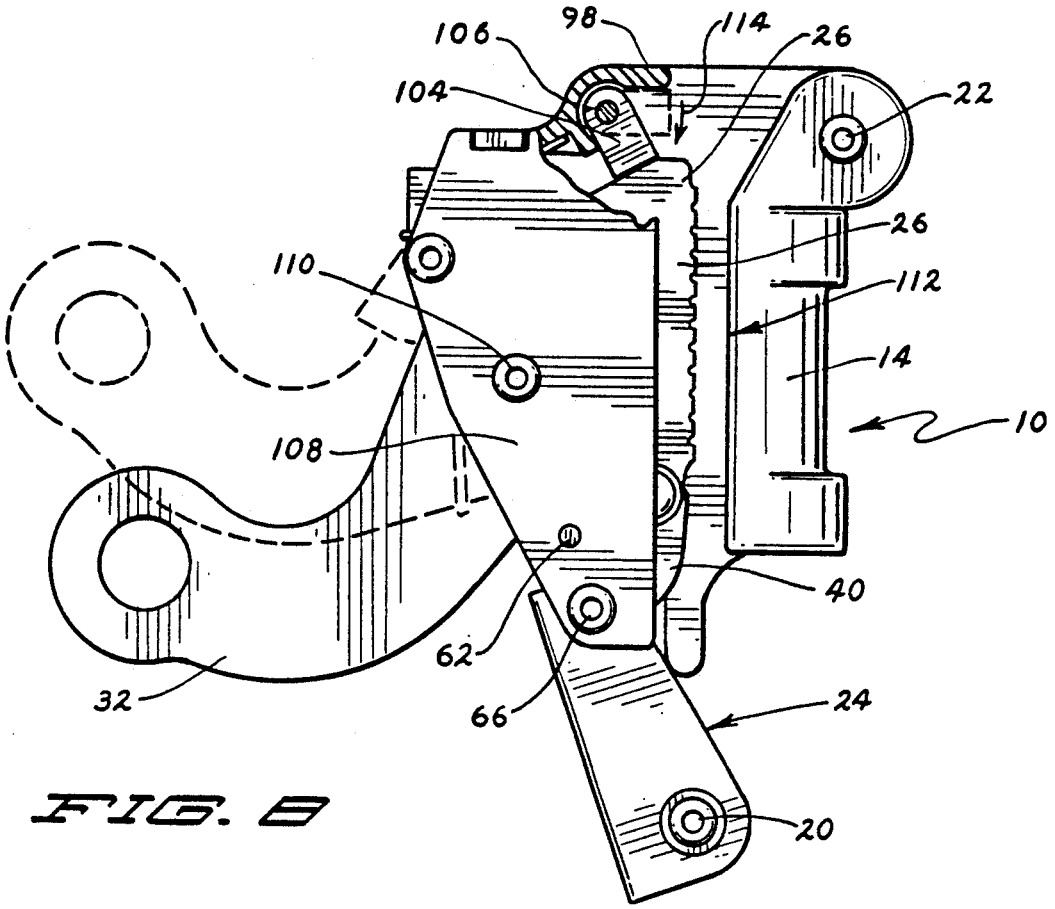
FIG. 8 is a side elevation of the safety clamp in an upside down orientation, with a portion cut away to show a safety feature of the device.

As may be seen in FIGS. 7 and 8, arm locking torsion spring 48 is positioned about the shoulder 50 of arm pivot post 52, which is cast into sleeve housing 13. The first end 54 of arm locking torsion spring 48 is positioned within spring retaining groove 56 formed in sleeve housing 13. The second end 58 of arm locking torsion spring 48 bears against the flat side surface 60 of spring retainer post 62.

Referring to FIGS. 4 and 5, actuating arm 32 is rotatably mounted to arm pivot post 52. The preferred embodiment of actuating arm 32 includes a brass bushing 64 friction fit into the opening within which arm pivot post 52 is inserted. Brass bushing 64 then provides the surface which contacts arm pivot post 52 as actuating arm 32 pivots about pivot post 52. The end of bushing 62 also rides against shoulder 50 of arm pivot post 52. Brass bushing 62 is preferably the same thickness as actuating arm 32, which is preferably approximately 0.25 inch thick, and is preferably made of stainless steel.

With reference to FIG. 7, hinged roller extension 24 is attached to sleeve housing 13 by rivet 66, about which roller extension 24 may pivot, as between the two positions illustrated in FIGS. 4 and 5. As indicated in FIGS. 4 and 5, the second end of lever arm 40 is also rotatably positioned about rivet 66. Finally, roller extension spring 68, which biases roller extension 24 toward the position shown in FIG. 4, is also mounted to rivet 66. As is true of all the springs used in safety clamp 10, roller extension spring 68 is preferably made of stainless steel. The first end 70 of roller extension spring 68 bears against spring retainer post 62, and the second end 72 of roller extension spring 68 bears against the inner surface of hinged roller extension 24.

Arm spring 74 is also mounted about arm pivot post 52. As shown in FIGS. 4 and 5, the first end 76 of arm spring 74 is anchored around spring retainer post 62, and the second end 78 wraps over the top of actuating arm 32. As is most clearly illustrated in FIGS. 6 and 7, second end 78 of arm spring 74 bears against stainless steel pin 80, projecting from actuating arm 32. In the preferred embodiment, pin 80 projects from actuating arm 32 approximately 0.125 inch.

Figure 6:
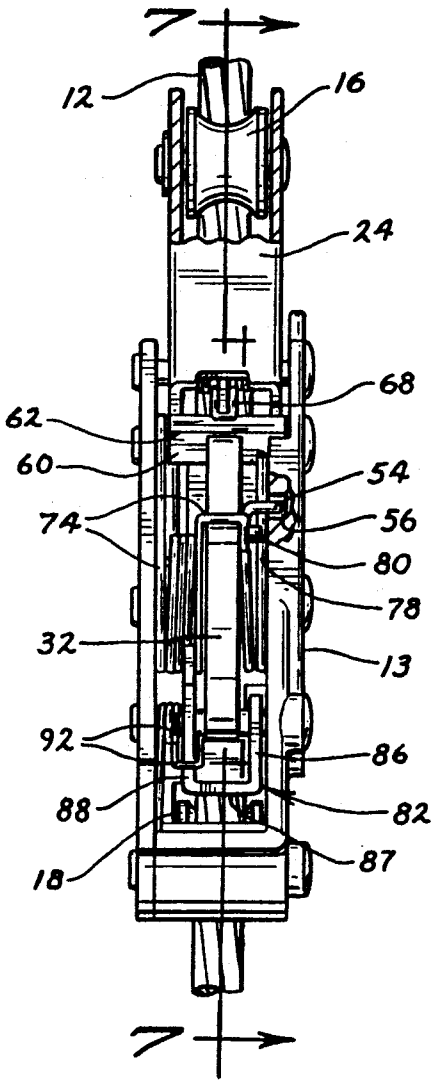
FIG. 6 is a right side elevation of the safety clamp.
Figure 9:
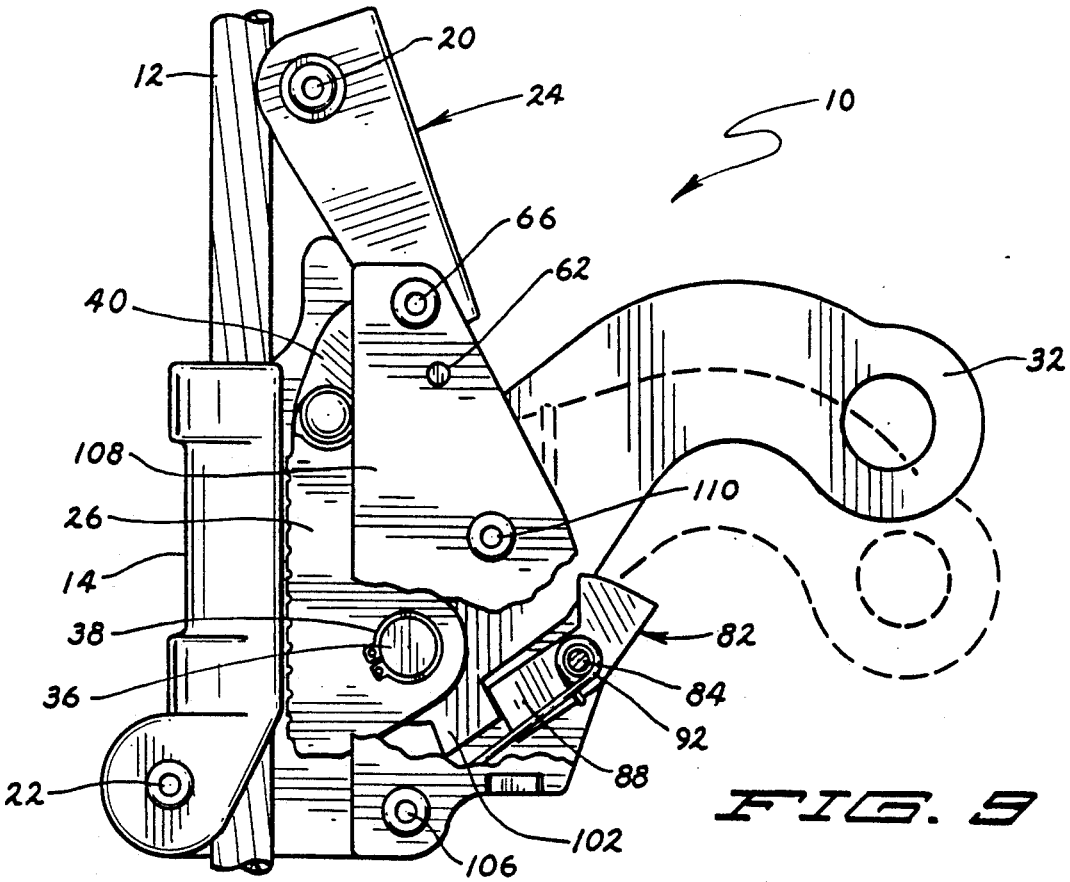
FIG. 9 is a side elevation of the safety clamp, with a portion cut away to show another safety feature of the device.

Palm-engaging sleeve lock 82 is also pivotally mounted to sleeve housing 13 using a rivet 84. As may be seen with reference to FIGS. 6, 7 and 9, the sleeve lock 82 safety feature is generally U-shaped, with a bridge portion 87 between first side 86 and second side 88 (FIG. 6), first side 86 being shorter than second side 88. As shall be seen, the extended portion projecting from second side 88 engages the user's hand H to enable the full range of motion of actuating arm 32. As shown in FIG. 7, sleeve housing 13 includes a boss 90 against which first side 86 of sleeve lock 82 abuts to maintain the proper resting position of sleeve lock 82. Also mounted to rivet 84 is sleeve lock spring 92. Sleeve lock spring 92 includes a first end 94 that engages a recess 96 in wall 98 of sleeve housing 13, and a second end 100 that engages and bears against second side 88 of sleeve lock 82 (FIG. 6). As illustrated in FIG. 9, actuating arm 32 includes a projecting portion 102 that engages the bridge portion 87 of sleeve lock 82 when sleeve lock 82 is biased into the locking position by sleeve lock spring 92.

Another important safety feature included with safety clamp 10 is gravity stop 104, illustrated in FIGS. 4, 5, 7 and 8. Gravity stop 104 is pivotally mounted to sleeve housing 13 on a rivet 106. Gravity stop 104 is intended to prevent the inadvertent installation of safety clamp 10 in an upside down configuration, as illustrated in FIG. 8. In FIG. 8, safety clamp 10 is shown as turned upside down, causing gravity stop 104 to pivot from its normal resting position, as shown in FIGS. 4, 5 and 7, to an interference position. There, gravity stop 104 engages brake shoe 26, limiting the range of motion of brake shoe 26. As may be seen, side plate 108 is fixedly attached to sleeve housing 13 using rivets 66, 84, 106 and 110, rivet 110 being inserted within a recess in arm pivot post 52. (An opening is also provided in side plate 108 for receiving the end of spring retainer post 62 to ensure that the post remains firmly anchored in its proper position.) Referring again to FIG. 8, a cable channel 112 is formed between side plate 108 and cable sleeve 14. It is through cable channel 112 that cable 12 is inserted into and removed from cable sleeve 14. To prevent safety clamp 10 from being improperly installed in an upside down configuration, gravity stop 104 will pivot about rivet 106 in the direction of arrow 114. When the user tries to move actuating arm 32 to withdraw brake shoe 26 from cable channel 112, brake shoe 26 engages gravity stop 104 before cable channel 112 is cleared. There will not be enough room for cable 12 to pass through cable channel 112 and enter cable sleeve 14, preventing safety clamp 10 from being improperly installed on cable 12. When safety clamp 10 is inverted back to its correct operating 15 position, as shown, for example, in FIG. 4, gravity stop 104 pivots back to its normal, inactive position, as also shown in FIG. 4.

In use, safety clamp 10 is installed onto an elongated safety carrier such as a rod or cable 12 by first grasping it, preferably in the user's right hand H, as illustrated in FIG. 5. Upon grasping safety clamp 10, sleeve lock 82 is engaged by the palm of hand H as hand H biases actuating arm 32 upwardly. Engaging sleeve lock 82 moves it from the position illustrated in FIG. 4, the position to which it is normally biased by sleeve lock spring 92, to the position illustrated in FIG. 5. In this position, projecting portion 102 of actuating arm 32 does not engage sleeve lock bridge portion 87, as illustrated in FIG. 9 and in phantom in FIG. 4, and actuating arm 32 may therefore be raised to the position shown in FIG. 5. In this position, brake shoe 26 is entirely withdrawn from cable channel 112, permitting cable 12 to be introduced into cable sleeve 14. While installing cable 12 into cable sleeve 14, hinged roller extension 24 must be pivoted out of the way of cable 12. This may be done by positioning upper roller 16 against cable 12 and allowing cable 12 to pivot hinged roller extension 24 rearwardly, as illustrated in FIG. 5, while inserting cable 12 into cable channel 112. Upon receiving cable 12 within cable sleeve 14, roller extension spring 68 will bias hinged roller extension 24 back to the normal position illustrated in FIG. 4.

Upon engaging sleeve lock 82 and raising actuating arm 32, pin 80 (FIGS. 7 and 8) engages first end 54 of arm locking torsion spring 48, which then slides along the length of spring retaining groove 56. Upon releasing safety clamp 10, both arm locking torsion spring 48 and arm spring 74 bias actuating arm 32 back to the normal use position illustrated in FIGS. 2 and 4. Additionally, sleeve lock spring 92 biases sleeve lock 82 back to its normal position. As shown in FIG. 7, sleeve lock 82 is biased against boss 90 by sleeve lock spring 92, defining the normal position of sleeve lock 82.

Under normal use conditions, safety clamp 10 is attached to harness or belt B of worker W, as illustrated in FIG. 1 and described above. When ascending or descending a climbing structure such as ladder L, brake shoe 26 is normally positioned as illustrated in FIG. 2. As shown in FIG. 7, when in this position, cable 12 is biased slightly from the inner wall of cable sleeve 14 by lower roller 18, and is biased slightly from the teeth 28 of brake shoe 26 by upper roller 16. Rollers 16, 18 thus provide a means for reducing the friction between cable 12 and safety clamp 10 during normal ascent and descent of ladder L by keeping cable 12 spaced from the stationary components of safety clamp 10 and allowing safety clamp 10 to roll with ease along the length of cable 12.

In the event worker W should fall from ladder L, the sudden downward force on actuating arm 32 would cause teeth 28 of brake shoe 26 to firmly engage cable 12, as illustrated in FIG. 4, stopping the descent of worker W. Although the fall would be brought to an abrupt and sudden halt, worker W would have had the opportunity to gain only very little momentum, and the sudden stop is therefore not likely to cause injury to worker W. The importance of gravity stop 104 becomes apparent when it is understood that if safety clamp 10 was to be installed in an upside-down position, as illustrated in FIG. 8, the sudden downward force on actuating arm 32 caused by a falling worker W would result in the withdrawal of brake shoe 26 from cable 12 and the disabling of safety clamp 10.

While the preferred embodiments of the invention have been described, it should be understood that various changes, adaptations, and modifications may be made therein without departing from the spirit of the invention and the scope of the appended claims.

What is claimed is:

1. A safety device adapted to be secured to a person working at an elevated level and having means to releasably engage an elongated safety carrier, such as a cable or rod, if the person falls, comprising:

a housing having a first side and a second side;

a sleeve fixed to said second side of said housing, whereby the elongated safety carrier to which the safety device is engaged passes through said sleeve;

an arm protruding from and pivotally linked to said housing;

a shoe, pivotally linked to said arm, for frictionally engaging the elongated safety carrier;

a channel in said first side of said housing for receiving the elongated safety carrier within said sleeve;

a lock pivotally attached to said housing for restricting the range of motion of said show, said lock being pivotable between a locked position and an unlocked position; and biasing means for biasing said lock to said locked position.

2. A safety device as recited in claim 1, further comprising:

means for reducing friction between the elongated safety carrier and said shoe during normal operation of the safety device.

3. A safety device as recited in claim 2, wherein:

said means for reducing friction comprises at the least one roller.

4. A safety device as recited in claim 3, wherein:

said means for reducing friction comprises a first roller and a second roller.

5. A safety device as recited in claim 1, further comprising:

gravity activated locking means, whereby said gravity activated locking means prevents the safety device from being incorrectly positioned on the elongated safety carrier.

6. A safety device as recited in claim 5, wherein said gravity activated locking means comprises:

a gravity lock engaging portion included on said arm; and a pivot member, whereby said pivot member engages said gravity lock engaging portion when the user attempts to position the safety device in a generally upside down configuration

7. A safety device as recited in claim 6, wherein:

upon engaging said gravity lock engaging portion, said pivot member interferes with the motion of said arm, which in turn obstructs said shoe, which in turn obstructs said channel, preventing the reception of the elongated safety carrier within said sleeve.

8. A safety device as recited in claim 3, further comprising:

a roller extension member pivotally attached to and projecting from said housing, said roller extension member including a said roller for reducing friction between the elongated safety carrier and said shoe.

9. A safety device as recited in claim 8, wherein:

said roller extension is biased to cause said roller to bear against the elongated safety carrier.

10. A safety device as recited in claim 3, wherein:

said sleeve includes a first said roller for reducing friction between the elongated safety carrier and said shoe, said roller being opposably positioned with respect to said shoe, permitting passage of the elongated safety carrier between said roller and said shoe.

11. A safety device as recited in claim 10, further comprising:

a roller extension member pivotally attached to and projecting from said housing, said roller extension member including a second said roller for reducing friction between the elongated safety carrier and said shoe.

12. A safety device as recited in claim 11, wherein:

said first roller and said second roller are position on opposing sides of the elongated safety carrier in normal use.

13. A safety device adapted to be secured to a person working at an elevated level and having means to releasably engage on elongated safety carrier, such as a cable or rod, if the person falls, comprising:

a housing having a channel through a sidewall thereof for slidably receiving the elongated safety carrier;

means for linking said housing to the person;

means for releasably engaging the safety device in a fixed position relative to the elongated safety carrier; and means for restricting the range of motion of said means for releasably engaging the safety device movable between a locking position and an unlocking position; and means for biasing said motion restricting means to said locking position.

14. A safety device as recited in claim 13, further comprising:

means for preventing the safety device from being positioned upside down on the elongated safety carrier.

15. A safety device adapted to be secured to a person working at an elevated level and having means to releasably engage an elongated safety carrier, such as a cable or rod, if the person falls, comprising:

a housing having a first side and a second side;

a sleeve fixed to said second side of said housing, whereby the elongated safety carrier to which the safety device is engaged passes through said sleeve;

an arm protruding from and pivotally linked to said housing;

a shoe, pivotally linked to said arm, for frictionally engaging the elongated safety carrier; and means for preventing the safety device from being positioned upside down on the elongated safety carrier.

16. A safety device adapted to be secured to a person working at an elevated level and having means to releasably engage an elongated safety carrier, such as a cable or rod, if the person falls, comprising:

a housing for slidably receiving the elongated safety carrier;

means for linking said housing to the person;

means for releasably engaging the safety device in a fixed position relative to the elongated safety carrier; and means for preventing the safety device from being positioned upside down on the elongated safety carrier.

* * * * *

UNITED STATES PATENT AND TRADEMARK OFFICE

CERTIFICATE OF CORRECTION

PATENT NO. : 5,265,696
DATED : November 30, 1992
INVENTOR(S) : Scott C. Casebolt It is certified that error appears in the above-indentified patent and that said Letters Patent is hereby corrected as shown below:

col 1, ln 37, delete "are" and insert --area-- therefore.

col 2, ln 61, delete "ma" and insert --may-- therefore.

col 4, ln 66, delete "15" therefrom.

col 6, claim 1, line 20, delete "show" and insert --shoe-- therefore.

Signed and Sealed this

Tenth Day of May, 1994

Bruce Lehman

*Attest:*

BRUCE LEHMAN

*Attesting Officer*

*Commissioner of Patents and Trademarks*